US008820229B2

(12) United States Patent
Grattan et al.

(10) Patent No.: US 8,820,229 B2
(45) **Date of Patent: *Sep. 2, 2014**

(54) PRODUCTION SPRING STRIPER

(71) Applicant: Dell Marking, Ferndale, MI (US)

(72) Inventors: Michael A. Grattan, Ferndale, MI (US); Jeffrey Brown, Ferndale, MI (US); Norton Delidow, Ferndale, MI (US); Michael Krieg, Ferndale, MI (US)

(73) Assignee: Dell Marking, Ferndale, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/724,874

(22) Filed: Dec. 21, 2012

(65) Prior Publication Data

US 2014/0026770 A1 Jan. 30, 2014

Related U.S. Application Data

(63) Continuation of application No. 13/161,908, filed on Jun. 16, 2011, now Pat. No. 8,342,087, which is a continuation of application No. 12/058,072, filed on Mar. 28, 2008, now Pat. No. 7,966,930.

(60) Provisional application No. 60/909,173, filed on Mar. 30, 2007.

(51) Int. Cl.
*B41F 17/00* (2006.01)

(52) U.S. Cl.
USPC ..... 101/35; 101/327; 401/137

(58) Field of Classification Search
USPC ..... 101/35, 327, 333, 368; 401/103, 108, 401/137, 138, 139, 261
See application file for complete search history.

(56) References Cited

U.S. PATENT DOCUMENTS

| | | | | |
|---|---|---|---|---|
| 3,788,753 | A * | 1/1974 | Stewart | 401/134 |
| 4,023,490 | A | 5/1977 | Marozzi | |
| 4,444,108 | A * | 4/1984 | Jenness, III | 101/305 |
| 4,566,382 | A * | 1/1986 | Bronson et al. | 101/35 |
| 4,794,857 | A | 1/1989 | Waters, Sr. | |
| 7,104,196 | B1 | 9/2006 | Fong et al. | |

* cited by examiner

*Primary Examiner* — Ren Yan
(74) *Attorney, Agent, or Firm* — The Dobrusin Law Firm, PC

(57) ABSTRACT

The present invention is directed to an apparatus for applying markings, particularly to springs, that are clean (ink in self contained storage units), allows quick color changes and reduces wasted ink or paint. An application means that does not dry out during short down time periods, keeps up with production rates, and is cost effective.

8 Claims, 3 Drawing Sheets

PRODUCTION SPRING STRIPER

CLAIM OF PRIORITY

This application is a continuation of Ser. No. 13/161,908 filed on Jun. 16, 2011 (Now U.S. Pat. No. 8,342,087, issued on Jan. 1, 2013) which is a continuation of Ser. No. 12/068,072, filed on Mar. 28, 2008 (Now U.S. Pat. No. 7,966,930 issued on Jun. 28, 2011), which claims benefit of provisional application Ser. No. 60/909,173 filed on Mar. 30, 2007, which are both hereby incorporated hereby reference for all purposes.

FIELD OF THE INVENTION

An apparatus for applying a stripe to a article like in a production line, particularly to a self-contained marking apparatus with a gravity feed system for applying a stripe, stripes or both to a spring.

BACKGROUND

It is common practice within industry to place a mark on individual articles (e.g. a stripe to a spring) to identify the article (e.g. the type of spring) that has been produced. In the case of a spring, each type of spring is assigned its own color stripe for identification purposes. This currently is being accomplished via both manual and automated processes, depending on the size and complexity of the manufacturing operation.

A manual system generally utilizes a worker to physically "paint" on a stripe on each spring and is obviously very labor intensive, costly and subject to a higher level of human error. Change over from one color to another generally requires someone to flush out the ink application system, then add the new color, and then adjust the metering system to insure that the proper amount of ink is being dispensed on the new spring. A very time consuming process. Down time can be a problem because the application tip typically can dry out in a relatively short time, even as short as during a typical 10-minute break period. Cleanliness can also be a concern with the current methods and devices of today. Operators can easily come in contact with the inks and spread the colors over the manufacturing environment, making an undesirable mess. A high rate of improperly marked or un-marked springs is also a hallmark of the current technology, which can cost significant time and energy in sorting activities.

The state of the art automated systems are cost prohibitive for the smaller manufacturer and has its own set of issues.

Accordingly, there is an industry need for a cost effective, clean and agile apparatus to mark springs.

SUMMARY OF THE INVENTION

The present invention is directed to one such solution, and particularly is directed to an apparatus that is clean (ink in self contained storage units), allows quick color changes and reduces wasted ink, an application means that does not dry out during short down time periods, keeps up with production rates, effectively meters an appropriate amount of marking media and is cost effective.

DETAILED DESCRIPTION OF THE PREFERRED EMBODIMENT

Figure 1B:
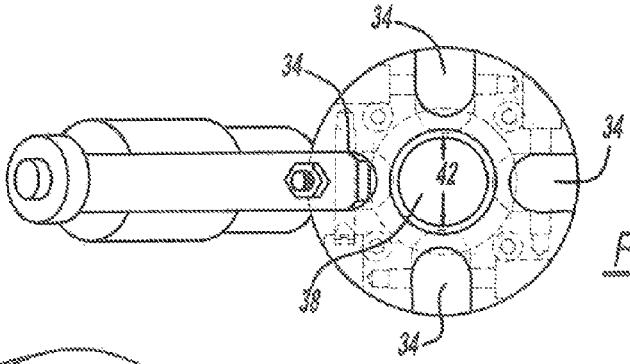
FIG. 1B illustrates the marking apparatus from one end showing multiple mating areas.

The present invention is directed to one such solution, and particularly is directed to a self-contained marking apparatus 20. This marking apparatus 20 includes a spring line interface 22 and a holding device 24 pivotally attached to the interface 22. The marking apparatus 20 contains at least one container 26 of ink or marking media, preferably multiple containers with multiple colors of marking media therein. It is contemplated that the marking apparatus 20 advantageously relies on gravity to both aid in holding the apparatus in place and to aid in the marking action, although other structures (e.g. springs or the like) may be utilized.

Spring Line Interface

The spring line interface 22 is a device that at least provides a holding section 28 and a path 30 for a spring 32 to move through. Optionally, the interface 22 also includes a marking section 40. It is contemplated that the spring line interface 22 may be constructed of a metal, plastic, or composite material. Preferably, the spring line interface 22 is constructed of aluminum.

Figure 1C:
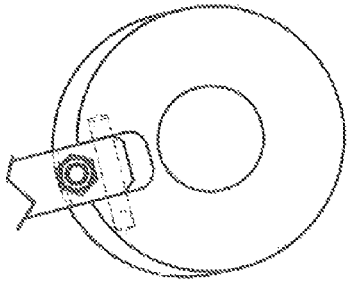
FIG. 1C illustrates the marking apparatus from one end showing one mating area.
Figure 1A:
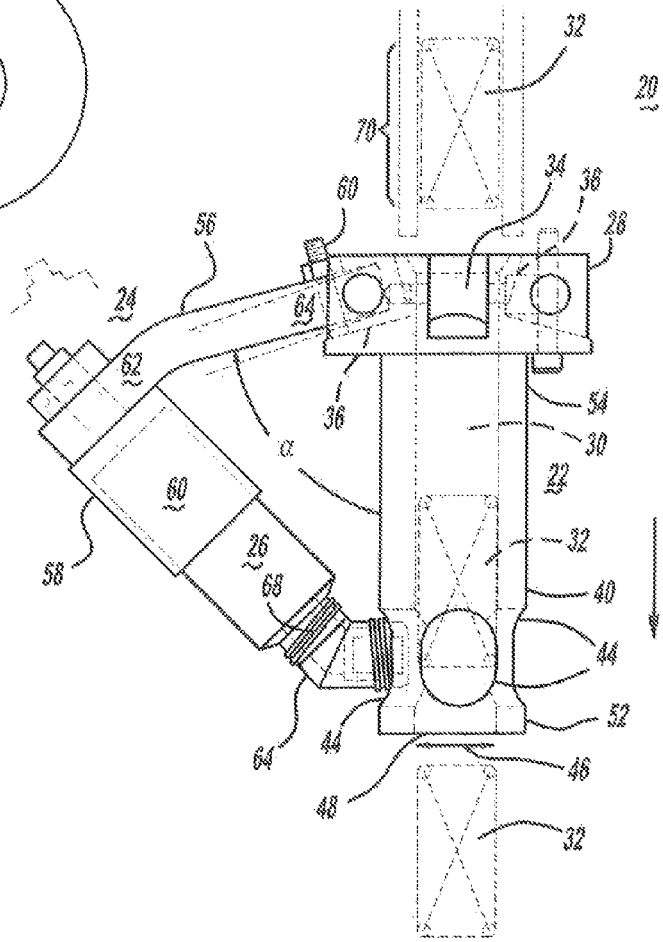
FIG. 1A illustrates a self-contained marking apparatus.

The holding section 28 provides at least one mating area 34 where holding device 24 is pivotally connected to and includes an adjustment surface 36. The adjustment surface 36, as shown in FIG. 1 is preferably angled away from a centerline of the path 30 by about 105° (+/−20%), The holding section 28 may contain single mating area 34, or multiple mating areas (e.g. 2, 3, 4 or more), each adapted to hold and angular movement of an individual holding device 24. The path 30 is a through-hole 38 that is adapted to allow the spring 32 to pass through. Preferably, the through-hole 38 had a cross-sectional area 42 that is matched to and slightly larger (e.g. about 1% to about 10%) to the cross-section of the spring that will pass through it.

The optional marking section 40 is hollow tubular device with at least one marking port 44 in a lower end 52 and is connected to the holding section 28 at an upper section 54. The marking section cross-sectional area 46 is similar to and preferably the same as the holding sections cross-sectional area 42, so that the spring 32 can pass through it. The at least one marking port is a marking through-hole 48 that is adapted so that a marking end 50 of the holding device 24 may be in contact with the spring 32 as it passes through the marking section 40. It is contemplated that the optional marking section 40 is long enough so that the applicator tip 66 (discussed below) will pass through the marking through-hole 48. It is contemplated that the marking section 40 may be constructed of a metal plastic, or composite materiel. Preferably, the marking section 40 is constructed of aluminum.

Holding Device

The holding device 24 is constructed to retain the marking media generally above the spring production line to facilitate the introduction of the color stripe to the spring 32. The holding device 24 includes a swing arm 56, a switching means 58 and the marking media container 26, the swing arm 56 pivotally attached at an upper section 64 to the holding section 28 of the spring line interface 22. The holding device 22 includes an adjustment means or device (e.g. set screw 60) to allow the angle of the swing arm 56 to be adjusted (e.g. moved towards or away from the spring 32). The adjustment means interfaces with the adjustment surface 36.

Figure 2A:
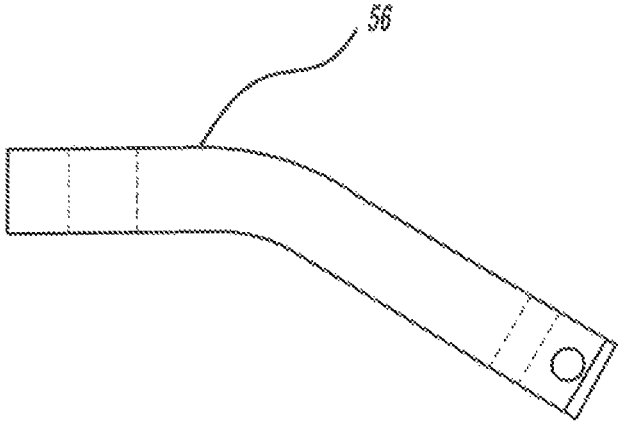
FIG. 2A illustrates a bent swing arm of the holding device.
Figure 2B:
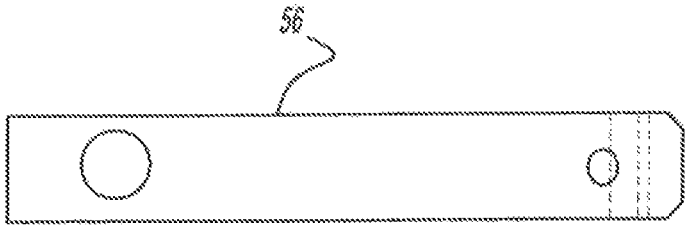
FIG. 2B illustrates a straight swing arm of the holding device.
Figure 2C:
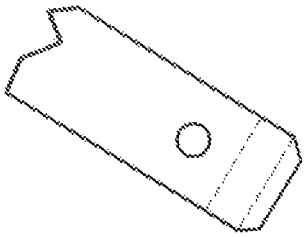
FIG. 2C illustrates an end of straight swing arm of the holding device.

It is contemplated that the swing arm 56 is angled, as shown in FIG. 2. Preferably, as shown in FIG. 1, the swing arm 56 is bent near the switching means 58 at an angle that places the marking media container 26 at an about 45° angle (+/−20%) to the plane that the spring 32 traverses.

The holding device 24 also contains a switching means 58, for changing from one color to another. This could be a simple as a clipping means where the marking apparatus clips in and out when changing colors. In one preferred embodiment, as shown in FIG. 1, the switching means includes a cup 60 which is adapted to hold the at least one container 26 of marking media and is connected to a lower section 62 of the swing arm 56. In another embodiment, this switching means 58 is accomplished by moveable surface, which the marking media container 26 is movably affixed to, whereby the moveable surface can be indexed to place the desired marking media container 26 in a position to be introduced to the springs to be striped.

Marking Media Container

Figure 3A:
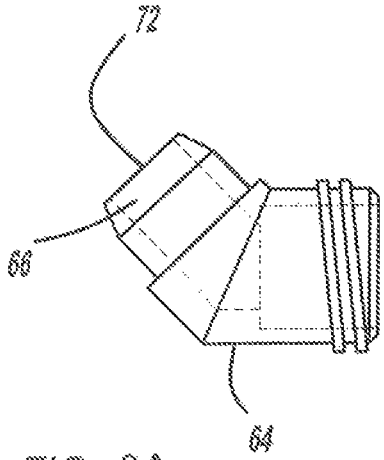
FIG. 3A illustrates an applicator end.
Figure 3B:
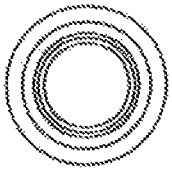
FIG. 3B illustrates another view of an applicator end.
Figure 3C:
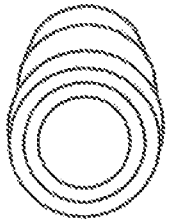
FIG. 3C illustrates yet another view of an applicator end.

The marking media container 26 is comprised of a fluid impermeable container 68 for holding the marking media with an angled application end 64. Preferably, the container 26 is constructed of a plastic material. The angled applicator end 64 includes an applicator tip 66 and a valve tip (not shown), where the marking media flows from the container 26 through the valve tip, also known as the applicator valve, and is introduced to the spring to be marked via the applicator tip 66. The angled applicator end 64, as seen in FIG. 3, is preferably angled at about a 45% (+/−20%) angle to the fluid impermeable container 68.

The applicator valve is preferably movable (e.g. spring loaded) to allow for the marking media to flow only when it is in contact with the spring to be marked. Preferably, the applicator tip 66 is comprised of an open cell material (e.g. plastic foam, polyester, TRICOT, cotton or natural fibers, or any synthetic fabric material that retains moisture). In one more preferred embodiment, the applicator tip 66 is a TRICOT style material. The applicator valve is constructed in such a way as to regulate or meter the amount of marking media that is dispensed is match the mount needed to mark the spring 32.

It is contemplated that through the respective angles of the swing arm 56 (as it is adjusted to the adjustment surface 36), the marking media container 26 (with the angled application end 64) that a lower surface 72 of the applicator tip 66 contacts the spring 32 at an angle that is parallel or near parallel (+/− about 5% from parallel) to a side surface 70 of the spring 32. In another embodiment, the swing arm, the switching means and the marking media container combine to form an angular bend of an at least about a 40° arc, preferably at least a 70° arc (arc $\alpha$). The self-contained marking apparatus 20 preferably utilizes gravity to hold the applicator tip 66 in place to contact the passing spring and provides an adjustable amount of contact pressure and/or contact area to the spring 32 by the adjustment means (e.g. set screw 60) of the holding device 24.

The Marking Media

The marking media is comprised of a ink or paint that is specifically formulated to have a viscosity and drying time allow it to flow through the valve tip, applicator tip 66, and allow for rapid drying on the spring to be marked. Preferably, the marking media will have a viscosity that ranges from 10 cps to 5000 cps, more preferably from 50 cps to 700 cps and even more preferably from 75 cps to 165 cps. Viscosity is measured with a Standard Laboratory type Ford Viscosity Cup and with a method compatible with ASTM D 1200. The drying time (e.g. time until the ink or paint can be handled without transferring the ink or paint from the marked surface) is preferably ranging from 2 to 120 seconds, more preferably from 5 to 60 seconds and even more preferably from 5 to 20 seconds or less under ambient temperatures (e.g. from about 60 to 80° F.).

Example

As an illustrative example, the structure of one embodiment of the inventive self-contained marking apparatus is shown. This example should not be considered limiting as to the scope of the current invention and the relative dimensions of the illustrative marking apparatus can be larger, smaller or both depending on the packaging restraints of the polymeric system being monitored. The structure may be employed for applications beyond the scope of the examples, as taught throughout. One or more of dimensions illustrated likewise may vary by +/−10%, 20%, 30% or higher. Relative proportion even if not specified herein are also contemplated within the present teachings.

As an illustrative example, as shown in FIG. 1, a spring 32 travels down a production line and through the path 30 in the center of the spring line interface 32. A holding device 24 is balanced on a hinged arm 32. As the spring travels through the interface 32, at least part of the side surface 70 engages the marking media container 26 at the applicator tip 66. The spring 32 depresses a spring loaded valve tip, thus activating the valve, providing a minimal amount of marking media to flow out and through the applicator tip 66. As the spring is marked and travels beyond the applicator tip 66, the marking apparatus disengages and the flow of marking media ceases until the next spring 32 in the production line comes into contact with the self-contained marking apparatus.

The skilled artisan will recognize that the above teachings may be modified in any of a number of ways yet still stay within the scope of the present invention. The skilled artisan will recognize, however, that from application to application, design requirements will vary, and therefore a reasonable amount of experimentation may be needed to adapt the various teachings to the unique intended environment.

What is claimed is:

1. An apparatus for applying a mark to an article comprising:

a. a spring line interface that includes a path defined by a through-hole that is adapted to allow the article to pass through and a marking section; and b. a holding device that is pivotally attached to the spring line interface, wherein the holding device includes a swing arm, a switching means and a marking media container with a marking media therein; wherein the marking media container includes an angled application end that contacts the article and applies the marking media to the article as the article passes through the marking section of the interface, and further wherein the marking media will dry on the article within about 5 to 20 seconds under an ambient temperature.

2. The apparatus of claim 1, wherein the article is a spring.

3. The apparatus of claim 2, wherein a lower surface of an applicator tip is disposed so that it contacts the spring at an angle that is parallel or within plus or minus of about 5% from parallel to a side surface of the spring.

4. The apparatus of claim 1, wherein the holding device is held in place by the force of gravity.

5. The apparatus of claim 1, wherein the swing arm, the switching means and the marking media container includes an angular bend to form at least a 70° arc.

6. An apparatus for applying a paint or ink mark to a side of a spring comprising:

a. a spring line interface including a holding section with at least one mating area and adjustment surface, marking section with at least one marking port, and a path, the path defined as a through-hole adapted for the spring to move through;

b. a holding device including a swing arm that is pivotally attached to the holding section of the spring line interface at the at least one mating area, an adjustment device, a switching means and a marking media container with a marking media therein; wherein the marking media container includes en angled application end that contacts and applies the marking media to the spring as the spring passes the at least one marking port, and further wherein the marking media will dry on the article within about 5 to 20 seconds under an ambient temperature.

7. The apparatus of claim 6, wherein the holding device is held in place by the force of gravity.

8. The apparatus of claim 6, wherein the swing arm, the switching means and the marking media container includes an angular bend to form at least a 70° arc.

* * * * *

UNITED STATES PATENT AND TRADEMARK OFFICE

CERTIFICATE OF CORRECTION

PATENT NO. : 8,820,229 B2
APPLICATION NO. : 13/724874
DATED : September 2, 2014
INVENTOR(S) : Michael A. Grattan et al.

It is certified that error appears in the above-identified patent and that said Letters Patent is hereby corrected as shown below:

In the Claims

Column 4, Claim 1, Line 58, insert --springline-- before interface
Column 5, Claim 6, Line 16, replace “en” with “an”

Signed and Sealed this
Eleventh Day of November, 2014

Michelle K. Lee

Michelle K. Lee
*Deputy Director of the United States Patent and Trademark Office*